United States Patent [19]

Patterson, II

[11] 4,456,444

[45] Jun. 26, 1984

[54] MODIFIED RSR ROTARY ATOMIZER

[76] Inventor: Robert J. Patterson, II, 496 SW. Eastport Cir., Port St. Lucie, Fla. 33452

[21] Appl. No.: 453,197

[22] Filed: Dec. 27, 1982

[51] Int. Cl.[3] ..... B01J 7/14

[52] U.S. Cl. ..... 425/8

[58] Field of Search ..... 425/8

[56] References Cited

U.S. PATENT DOCUMENTS 4,140,462 2/1979 Thompson ..... 425/8
4,178,335 12/1979 Metcalfe et al. ..... 425/8
4,207,040 6/1980 Metcalfe et al. ..... 425/8
4,310,292 1/1982 Carlson et al. ..... 425/8

*Primary Examiner*—James R. Hall
*Attorney, Agent, or Firm*—Stephen E. Revis

[57] ABSTRACT

To produce metal powders by rotary atomization molten metal is poured onto the surface of a spinning disk. The central portion of the disk is ceramic. Onto the upper surface of the ceramic portion is bonded a protective layer of metal compatible with the molten metal to be poured. The molten metal is poured directly onto this metal layer which prevents contact with the ceramic. The metal of the protective layer is selected such that proper atomization and no significant contamination of the atomized metal occurs during a run.

6 Claims, 1 Drawing Figure

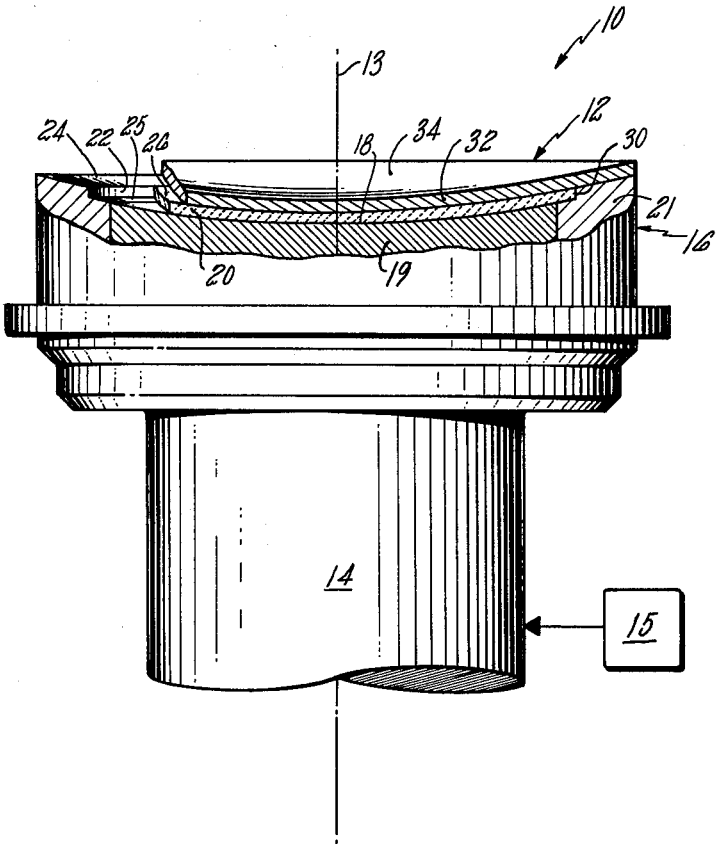
10
13
12
24
22
25
26
18
34
32
30
21
16
20
19
14
15

MODIFIED RSR ROTARY ATOMIZER

CROSS REFERENCE TO RELATED PATENT APPLICATIONS

This application is of related subject matter to commonly owned U.S. patent application Ser. No. 453,197 filed on even date herewith titled "Improved Rotary Atomizing Process", by Romeo G. Bourdeau, now issued as U.S. Pat. No. 4,415,511.

Technical Field

This invention relates to atomizing molten metals and apparatus therefor.

Background Art

It is well known in the art to form metal powders and metal splats by pouring molten metal onto the top surface of a spinning disk which flings molten metal droplets outwardly into a quenching chamber and/or against a splat plate. The body of the atomizer disk is typically made from a high strength metal which can withstand the centrifugal loads at the high rotational speeds and temperatures to which it will be subjected. It was early on recognized that metals most suitable for forming the structural portion of the atomizer disk sometimes reacted with the molten metal being poured, thereby contaminating the metal powder being manufactured; also, some of these metal disks were being eroded and/or melted by the direct impingement of the molten metal onto their surfaces. These problems become even more severe as one tries to make metal powders from metals having very high liquidus temperatures.

One early solution to this problem involved lining the top surface of the metal atomizer disk with a refractory material, as shown in U.S. Pat. No. 2,439,772 to J. T. Gow. The refractory material, in addition to providing thermal protection for the underlying metal of the disk, was also felt to be inert or nonreactive to most molten metals. Even today the state-of-the-art of high speed rotary atomization for making powdered metal involves pouring the molten metal onto a ceramic layer which has been bonded to the surface of a metal atomizer disk, as is shown in U.S. Pat. Nos. 4,178,335 to R. A. Metcalfe and R. G. Bourdeau and 4,310,292 to R. L. Carlson and W. H. Schaefer, both owned by the assignee of the present application.

Despite recent advances in the art which have permitted higher disk speeds and more efficient atomization, such as the advances described in the above-mentioned Metcalfe et al and Carlson et al patents, it has been discovered that some molten metals, such as titanium, as well as many alloy constituents, such as the hafnium and yttrium constituents of some nickel base superalloys, react with most ceramics of the type used for atomizer coatings. These reactions may be detrimental since they change the resulting composition of the atomized alloy and they also erode the ceramic coating. Notwithstanding the potential contamination of the metal powder, continued erosion of the ceramic layer can result in exposure of the underlying metal and ultimately a catastrophic failure of the atomizer.

In order to form uniformly sized fine metal particles it is necessary that the molten metal wet the surface of the atomizer disk, as discussed in U.S. Pat. No. 2,699,576, Colbry et al. Otherwise, the molten metal forms globules which roll and bounce on the surface and are too large and nonuniform in size as they are flung off the surface. In Colbry et al magnesium is to be atomized on a steel disk. Zinc and zirconium are added to the magnesium so that the magnesium mixture wets the surface of the steel atomizer. Some metals wet the surface of ceramic, but others do not. This is another shortcoming of prior art ceramic coated atomizers.

Metal "skulls" formed by the solidification of the molten metal upon hitting the cool ceramic surface of the atomizer at the beginning of a run have proved to be beneficial, since a skull provides a wettable surface over which the molten metal may flow (see U.S. Pat. No. 4,178,335 to Metcalfe et al); however, the skull may form around and adjacent the periphery but not at the center of the atomizer disk because temperatures are too high at the center. In those instances the molten metal stream continuously impinges upon the exposed ceramic surface, which is undesirable as pointed out above.

From the foregoing it becomes apparent that ceramic coated atomizer disks of the prior art have some shortcomings which have not been resolved.

The following additional patents are representative of the state-of-the-art in the field of rotary atomization: U.S. Pat. Nos. 4,069,045; 3,721,511; 4,140,462; 4,207,040; and British Pat. No. 754,180.

DISCLOSURE OF INVENTION

One object of the present invention is an improved method and apparatus for forming metal powders.

Another object of the present invention is a method for reducing contamination of metal powders made by rotary atomization techniques.

Accordingly, in the method of the present invention molten metal to be atomized is poured onto the surface of a spinning disk having an upwardly facing central ceramic surface onto which has been bonded, prior to pouring of the molten metal, a layer of metal compatible with the molten metal being poured. The metal layer prevents contact between the molten metal and the ceramic and is selected such that proper atomization and no significant contamination of the atomized metal occurs during a run.

To be compatible the metal layer must have a solidus temperature at least as high as and preferably higher than the temperature of the molten metal, and it should not interact with the molten metal in a manner which would result in either unacceptable impurities in the metal powder being produced or unacceptable removal of material from the metal layer.

In addition to compatibility, it is preferred, although not required, that the metal layer be wettable by the molten metal to eliminate the need to form a metal skull during operation. In any event, if a metal skull is formed, but is incomplete at the center of the disk, the underlying compatible metal layer, and not the ceramic, becomes exposed to the molten metal stream.

BRIEF DESCRIPTION OF THE DRAWING

The sole FIGURE is a simplified side elevation view, partly broken away, of a rotary atomizer according to the present invention.

BEST MODE FOR CARRYING OUT THE INVENTION

With reference to the drawing, the simplified view of rotary atomization apparatus 10 shows an atomizer disk 12 having an axis 13, and fixedly mounted on the upper end of a drive shaft 14 which can be rotated about the axis 13 at very high speeds by any suitable means, such as an electric motor or air turbine, shown schematically as block 15. It is contemplated that the disk 12 will be cooled, such as by circulating a flow of coolant fluid through cavities therewithin or against a sufficiently large surface area of the disk 12 so as to maintain its temperature below predetermined limits which are necessary to the disk retaining its structural integrity under operating conditions. Neither the means for attaching the disk 12 to the shaft 14 nor the means for cooling the disk 12 are shown in the drawing since they are not considered to be a part of the present invention. Examples of suitable means for attaching an atomizer disk to a drive shaft and for cooling a disk may be found in previously referred to U.S. Pat. Nos. 4,178,335 and 4,310,292, which are incorporated herein by reference.

The disk 12 comprises a body 16 having an upwardly facing concave central surface 18. The body 16 is preferably metal, but it may be made from any material or combination of materials having the requisite strength and thermal conductivity properties for the conditions under which it is to be run. In the exemplary embodiment shown in the drawing, the disk body 16 comprises a central core 19 of high heat transfer material, such as copper, surrounded by a ring 21 of high strength metal, such as stainless steel. The ring 21 has a top surface 24 located above the surface 18. The upper, inner periphery of the ring 21 includes an annular groove 22. The groove 22 and surface 18 define a recess 25 in the disk body 16. A ceramic layer 20 covers and is securely bonded to the surface 18 and fills the recess 25. Examples of ceramics which may be used for this type of application are $MgZr0_3$, $Al_20_3$ and $Mg0$. An upwardly facing surface 26 of the ceramic layer 20 is flush with the top surface 24 of the ring 21. The ring 21 surrounds and is in contact with a vertically extending peripheral surface of revolution 30 of the ceramic layer 20 and acts as a holder for the low tensile strength ceramic layer 20 to prevent it from failing under high centrifugal loads. Under appropriate circumstances the ring 21 and the core 19 could be a single piece.

In some cases an intermediate metal coating, perhaps on the order of 0.002–0.004 inch thick is first applied to the surface 18 of the disk body to assure a strong bond between the ceramic layer 20 and the disk body 16, as is well known in the art of bonding ceramics to metals. For example, if the ceramic layer is to be $MgZr0_3$ and the disk body 16 is a zirconium-containing copper base alloy such as AMZIRC® copper alloy, the surface 18 of the disk body 16 is first coated with NiAl. The ceramic layer 20 may then be applied to the coated surface 18 by any of several well known processes, such as by vapor deposition, conventional plasma spraying, or by the Gator-Gard® plasma spray process described in commonly owned U.S. Pat. No. 4,235,943. The ceramic layer must be at least thick enough to provide the required thermal insulation. The minimum necessary thickness will depend upon the properties of the underlying metal as well as the molten metal temperature and its residence time on the disk. Furthermore, although shown as a relatively thin coating, the ceramic layer could instead be a separately formed insert of relatively large thickness which is attached to the disk body 16 by bonding or even mechanical means, such as shown and described in commonly owned U.S. Pat. No. 4,419,061.

Bonded to the concave upwardly facing surface 26 of the ceramic layer 20 is a metal coating or layer 32 having a concave, upwardly facing surface 34, which is the uppermost surface of the disk 12 and onto which the stream of molten metal is poured during operation. The metal layer 32 covers the entire upwardly facing surface 26 of the ceramic layer 20 as well as the annular surface 24 of the ring 21. The outer periphery of the metal layer 32 is bonded directly to the metal of the disk body 16 at the surface 24. This is beneficial since the metal-to-metal bond will be stronger than the metal-to-ceramic bond at the surface 26. Like the ceramic layer 20, the metal layer 32 may be applied by any of several well-known processes, such as by conventional plasma spraying, the Gator-gard plasma spray process, or vapor deposition.

The appropriate thickness for the metal layer will depend upon several factors, including the rate of any interaction (chemical reaction and/or dissolution) between the metal layer and molten metal, and physical characteristics of the layer, such as strength and thermal conductivity. Its thermal expansion characteristics must also be compatible with the underlying material to which it is bonded. The bottom line is that it should not be so thin as to be completely removed in any area during the course of a run, and it should not be so thick as to fail mechanically. It is believed that metal layer thicknesses no greater than about 0.100 inch will be preferred under most circumstances.

As hereinabove discussed, the metal selected for the layer 32 must be compatible with the metal being poured onto it. The characteristics of the metal layer which determine compatibility are: (1) melting or solidus temperature of the metal layer, and (2) interaction (i.e., chemical reaction and/or dissolution) of the metal layer with the molten metal. The first characteristic is relatively straightforward. The solidus temperature of the metal layer 32 must be at least equal to and is preferably higher than the highest temperature of the liquid metal with which it comes into contact. With pure elements it can readily be determined whether the metal layer 32 will remain a solid at the temperature of the molten metal, assuming there is no interaction between the two metals which might result in the formation of an alloy having a melting point lower than the melting point of the metal of the layer 32.

The second characteristic involves the existence or nonexistence of an interaction between the metal being atomized and the metal of the layer 32. It is required that the metal layer be substantially nonreactive to the molten metal at the temperatures at which they come into contact in order to minimize and preferably avoid removal of the metal layer and to minimize the possibility of contaminating the metal being atomized. Chemical interaction with or dissolution of the metal layer should be minimal and preferably nonexistent over the length of time that the device is to operate, such that the metal layer remains intact during that period of time.

An example of an undesirable combination would be the use of nickel, iron, or most alloys thereof as a metal layer for the production of titanium or its alloys; and, conversely, the use of titanium or its alloys as a metal layer for the production of iron, nickel or their alloys. The reason is that iron and titanium, or nickel and titanium form eutectics which have very low melting points compared to those of the parent metals iron, nickel and titanium. Thus, removal of the metal layer by a combination of chemical interaction and melting, as well as contamination of the metal being atomized, would be very likely to occur.

Phase diagrams for two, three or more element combinations can be useful as a guide to determine compatibility between a particular metal layer (i.e., coating material) and the metal to be atomized. Basically, phase diagrams are used to determine the temperature at which dissolution would be expected to occur as between the coating material (or some element of the coating material) and the metal to be poured (or an element of the metal to be poured). Analysis of phase diagrams might immediately eliminate some metals as coatings for atomizing certain other metals; or, they may help determine over which temperature range certain metals might be compatible.

In addition to the metal layer 32 being compatible with the molten metal, it is also required that either (1) a skull of the metal being poured is formed on the metal layer 32 at the beginning of a run such that the molten metal wets the surface on which it is being poured during the run, or, (2) the metal layer 32 itself is wettable by the molten metal such that no skull need be formed. The latter alternative is most preferred in view of the difficulties associated with the formation of a stable skull.

Wettability studies can be performed by the well-known Sessile drop test. Thus, a small amount of the alloy to be atomized is placed on a flat surface of the proposed coating material, and the temperature is raised until melting of the alloy occurs and a droplet is formed. The angle, measured within the droplet, between the flat solid surface and a tangent to the droplet surface at the point of contact with the solid surface is a measure of the wetting. An angle of 90° indicates no wetting and an angle of zero degrees (i.e., the formation of a film) indicates complete wetting. Since increasing liquid temperature means reduced surface energy, then if suitable wetting does not occur at the melting temperature the molten metal can be superheated to increase its temperature to the point wherein suitable wetting is achieved, if such a temperature can be found. In general, if the molten metal is an alloy, only the major component of the alloy need be considered, since minor components will generally lower the surface tension of the liquid and make it easier to wet the metal layer.

It is also generally true that for a solid to be wettable by a liquid the solid must have a higher surface energy (or surface tension) than the liquid. It is also known from *The Handbook of Physics,* (Condon and Odishaw,McGraw-Hill, 1967), Chapter 5, that the surface energy of a material in solid form is usually higher than the surface energy of the same material in liquid form. In view of this fact, the surface tensions of different elements or alloys in the liquid state may be compared to each other to determine whether one of them in the liquid state will wet the other in the solid state. This is helpful since there is very little data on the surface tension of solids.

Based upon the foregoing factors, as an example of determining the suitability of one particular metal as a metal layer 32 for atomizing a different metal, consider the metals nickel and tungsten. The surface energy of pure nickel has been variously measured, at its melting point, at 1725–1822 dynes/cm. Tungsten, at its melting point, is reported to have a surface energy above 2200 dynes/cm. Therefore, solid tungsten should be wettable by molten nickel and by most other nickel-base alloys. Tungsten melts at about 6170° F., which is well above the melting point of nickel, which boils at 5252° F. Thus, melting would certainly not be a problem as between solid tungsten and molten nickel and most molten nickel-base alloys. The tungsten-nickel binary phase diagram indicates that nickel alloys may be poured on a tungsten coating up to 2647° F. without dissolving the tungsten coating. Thus, tungsten should be a suitable metal for the layer 32 when atomizing nickel and most nickel-based alloys, as long as the molten metal temperature remains below about 2647° F.

Based upon an analysis similar to the foregoing analysis of nickel and tungsten, it is believed that tungsten, platinum, technetium, chromium, rhodium, tantalum, osmium, rhenium, iridium, molybdenum, ruthenium, and mixtures thereof, including many alloys of such materials, would be suitable as metal layer materials for atomizing aluminum, iron, nickel, aluminum-base, iron-base, and nickel-base alloys. In particular, metal layers of many nickel alloys of such materials (i.e., tungsten, platinum, etc.) are believed to be suitable for atomizing nickel and its alloys; and metal layers of many iron alloys of such materials are believed to be suitable for atomizing iron and its alloys. For example, it is believed that molybdenum or many nickel-molybdenum alloys will be useful as metal layers for the atomization of many nickel-base alloys for which the temperature at the surface of the atomizer may be kept below 2405° F. For the atomization of iron and many of its alloys it is believed that metal layers of (1) tantalum and iron-tantalum alloys will be useful up to molten metal temperatures of 2570° F.; (2) chromium and iron-chromium alloys up to about 2745° F.; (3) molybdenum and iron-molybdenum alloys up to about 2642° F.; (4) tungsten and iron-tungsten alloys up to about 2777° F.; and (5) platinum, technetium, iridium, osmium or their alloys with iron to at least the melting point of pure iron, about 2794° F. Similarly, titanium layers may be used for the atomization of aluminum or aluminum alloys. Maximum temperatures given in the foregoing examples have been obtained from existing binary phase diagrams which presume equilibrium conditions. Since conditions on the surface of the atomizer are not in equilibrium, and because some dissolution may be tolerable, somewhat higher temperatures may be acceptable in many situations.

EXAMPLE I

An alloy comprising 17 atom percent boron, 8 atom percent silicon, balance nickel was properly atomized using an atomizer disk having a top layer 32 of molybdenum over a ceramic layer 20 of $MgZr0_3$ on a disk body 16 comprising a copper core 19 and stainless steel ring 21. The molybdenum layer was 0.003 to 0.006 inch thick and the ceramic layer was 0.030 to 0.040 inch thick. The molybdenum layer had a concave upper surface with a radius of curvature of about 5.6 inches. The diameter of the atomizer disk was about 4 inches and its rotational speed about 34,000 RPM. The atomized alloy has a eutectic temperature near 1800° F., a liquidus near 1950° F., and was poured onto the molybdenum-coated atomizer at a temperature of approximately 2460° F. The molybdenum layer 32 was completely wetted by the molten alloy. It is not believed that any significant contamination of the finished alloy powder occurred.

EXAMPLE II

In another test the same nickel alloy as in Example I was atomized on a similar atomizer, except the top layer was tungsten instead of molybdenum. The pour temperature was supposed to be about 2600° F., however, there is evidence that it may have been somewhat less. The initial atomizer speed was 33,500 RPM. Unfortunately, a bearing cracked a few seconds into the run, and the speed fell to 16,000–17,000 RPM, causing the size distribution of the powder to be much coarser than desired. However, the tungsten layer remained intact, and from that point of view the test was successful.

Although the invention has been shown and described with respect to a preferred embodiment thereof, it should be understood by those skilled in the art that other various changes and omissions in the form and detail thereof may be made therein without departing from the spirit and the scope of the invention.

What is claimed is:

1. Rotary atomization means comprising disk means having an axis and means for rotating said disk means about said axis, said disk means including a disk body and an upper concave surface adapted to receive a stream of molten metal thereon as it rotates, said disk body having a central ceramic component secured thereto, said ceramic component being of sufficient thickness to provide thermal insulation for said disk body, said ceramic component having a concave upwardly facing surface, said disk means including a metal layer covering said concave upwardly facing ceramic surface and bonded thereto, said metal layer defining said upper concave surface of said disk means and adapted to receive said molten metal stream without melting or substantially interacting therewith, said metal layer being wettable by the molten metal.

2. The atomization means according to claim 1 wherein said ceramic component includes a periphery comprising an outwardly facing vertically extending surface of revolution and said disk body includes metal holder means surrounding and in contact with said surface of revolution to retain said ceramic component.

3. The atomization means according to claim 1 wherein said disk body includes an upwardly facing metal surface, and wherein said ceramic component is a layer of ceramic bonded to and covering said metal surface.

4. The rotary atomization means according to claim 2 wherein said metal holder means includes a metal ring having an annular top surface surrounding and flush with said upwardly facing concave surface of said ceramic component, and the periphery of said metal layer is bonded directly to said top surface.

5. The rotary atomization means according to claim 3 wherein said metal layer is no greater than 0.010 inch thick.

6. The rotary atomization means according to claim 3 wherein the metal of the metal layer is selected from the group consisting of tungsten, platinum, technetium, chromium, rhodium, tantalum, osmium, rhenium, iridium, molybdenum, ruthenium, mixtures thereof, alloys thereof with nickel, and alloys with iron.

* * * * *